United States Patent [19]

Williams

[11] 4,088,598

[45] May 9, 1978

[54] LOW SUDSING DETERGENT COMPOSITIONS

[75] Inventor: Michael Kevin Williams, Seaton Delaval, England

[73] Assignee: The Procter & Gamble Company, Cincinnati, Ohio

[21] Appl. No.: 621,456

[22] Filed: Oct. 10, 1975

[30] Foreign Application Priority Data

Oct. 14, 1974 United Kingdom ..... 44385/74

[51] Int. Cl.[2] ..... C11D 1/825; C11D 3/075

[52] U.S. Cl. ..... 252/135; 252/99; 252/89 R; 252/108; 252/321; 252/544; 252/550; 252/551; 252/555; 252/558; 252/559; 252/DIG. 1

[58] Field of Search ..... 252/89, 99, 321, 358, 252/539, 558, DIG. 1

[56] References Cited

U.S. PATENT DOCUMENTS

| | | | |
|---|---|---|---|
| 2,753,309 | 7/1956 | Figdor | 252/358 |
| 2,868,734 | 1/1959 | De Castro et al. | 252/358 |
| 3,180,786 | 4/1965 | Domba et al. | 162/158 |
| 3,684,723 | 8/1972 | Best et al. | 252/132 |

FOREIGN PATENT DOCUMENTS

| | | |
|---|---|---|
| 1,172,959 | 2/1959 | France. |
| 1,243,312 | 6/1967 | Germany. |
| 45-7,973 | 3/1970 | Japan. |
| 80,630 | 2/1956 | Netherlands. |

*Primary Examiner*—P.E. Willis, Jr.

[57] ABSTRACT

The invention relates to novel suds-depressants and to detergent compositions containing them.

8 Claims, No Drawings

LOW SUDSING DETERGENT COMPOSITIONS

BACKGROUND OF THE INVENTION

With the development of front loading washing machines there has been a growing need for low sudsing detergent compositions and suds depressants. To obtain sufficient control of the sudsing of such compositions, particularly in some machines used on the continent of Europe where the washing temperatures can be as high as 95° C, has proved very difficult. It has proved especially difficult to find effective suds-depressants for nonionic surfactants. Thus high molecular weight fatty acids or soaps, which are effective with anionic surfactants, are almost useless with nonionics. Silicones and certain waxes (for instance as described in British Patent Applications 35877/72, 1370/74, 10734/72, 22552/74) are effective at suitable rather high levels in solid nonionic based detergent compositions, but the former tend to lose their effectiveness after a few hours storage in liquid detergents and it has so far proved impossible to keep the latter dispersed uniformly for long periods in aqueous liquid detergent compositions. All these, and, so far as we are aware, all other known suds-depressants tend to reduce the available cleaning power of the detergent compositions whether solid or liquid.

It has now been discovered that certain mono and polyalkoxy substituted surfactants having the terminal hydroxyl of the alkoxy group acylated by certain monobasic acids (referred to hereinafter as "capped" surfactants) wherein the capped surfactants have certain defined levels of components with specific HLB (hydrophilic lipophilic balance) values, are outstandingly effective suds-depressants for nonionic and zwitterionic detergents and even soaps. At the same time, the "capped" surfactants have substantially the same detergency characteristics as the non-capped precursor surfactants so that they may be used as suds-depressants in, say, nonionic detergent compositions without imposing any additional load on the performance of the composition. The "capped" surfactants may be used to render such detergent compositions substantially non-sudsing even in some washing machines prone to generate suds strongly, or they may be used to provide a low degree of sudsing, as generally preferred by the users of such products.

The novel suds-depressants have the further advantage that their suds-depressant action is greatest at high temperatures, where over-sudsing is most troublesome. In warm water, as in the hand wash, a moderate to low level of suds can be provided, and the suds which are formed are unusually stable. The suds-depressants also enhance the rinsing characteristics of the detergent composition.

Compounds of this general type having 3 to 50 alkoxy groups per molecule are described in Rohm & Haas DAS 1,243,312 as low sudsing surfactants compatible with nonionic and ionic surfactants. There is no general disclosure of a compound with less than 3 alkoxy groups per molecule, and no specific disclosure of a compound with less than 7.5 ethoxy groups per molecule, and no suggestion at all of the surprising suds depressant action of certain alkoxy derivatives in combination with other surfactants. Percentages and ratios are by weight and temperatures in degrees Centigrade unless otherwise indicated.

SUMMARY OF THE INVENTION

The present invention therefore provides a low sudsing detergent composition comprising:

(a) a nonionic, zwitterionic or anionic detergent or mixture thereof, and (b) a suds depressing surface active agent having the general formula $$R - Z - (AO)_{\bar{x}} - Ac$$

wherein R is a hydrophobic group comprising between 8 and 24 carbon atoms and being free of ionic or potentially ionic moieties;

Z is a direct or a heteroatom linkage;

AO is an alkylene oxide unit comprising up to 4 carbon atoms;

Ac is an acyl moiety comprising between 1 and 10 carbon atoms attached to the terminal alkylene oxide unit through an ester linkage; and $\bar{x}$ represents the average degree of alkoxylation of the surface active agent;

wherein the ratio of the weight of alkoxylated components of the suds-depressant having HLB values of less than 7.5 to the weight of detergent (a) is at least 1:1000.

The alkylene oxide units in a given chain may of course be the same or different.

DETAILED DESCRIPTION OF THE INVENTION

The detergent composition may be a liquid or solid laundry detergent or a hard surface cleaning, automatic dishwashing, industrial cleaning, emulsifying, cosmetic or dyeing auxiliary composition or any other composition requiring a low or zero level of suds in use.

As defined above, the hydrophobic group R is preferably a primary or secondary, branched or unbranched $C_{12}$ to $C_{18}$ alkyl or alkenyl radical or an alkyl phenyl radical having a $C_6$ to $C_{12}$ alkyl group or a polyalkyleneglycol group having, on average, more than 2 carbon atoms per alkylene group. R may also include hydrophobic derivatives of carbohydrates. The symbol Z may simply represent a direct link or a moiety chosen from O, S, $NR^1$, or $N^+ R^1 R^2$ groups, in which $R^1$ and $R^2$ are each a hydrogen atom or a radical comprising up to 24 carbon atoms or a mono- or di-alkylene glycol chain terminating in an ester group. Preferably no more than one of $R^1$ and $R^2$ should then be less than 40 carbon atoms.

The symbol Ac preferably represents a radical chosen from $COR^3$, $O(CO)R^3$, $SO_2R^3$ or $(PO)R^3R^4$ groups, in which $R^3$, $R^4$ are each a moiety, comprising between 1 and 9 carbon atoms, optionally linked through oxygen to the acyl radical, $R^3$, $R^4$ desirably comprising from 1 to 6 carbon atoms and most preferably 1 to 3 carbon atoms. Of the above groups, it is preferred to incorporate an acyl residue derived from a monobasic carboxylic acid.

One of the key characteristics of the suds-depressant is its distribution in terms of ethoxylate content. In more general terms, the defining characteristic is the hydrophilic-lipophilic balance (HLB) which, of course, correlates with ethoxylate content for a particular homologous series of surfactants. Certain processes for alkoxylation of a substrate, e.g. an alcohol, may lead to a number of species having a spread of different alkoxy chain lengths and HLB values. The exact form of the HLB distribution is entirely dependent upon the nature of the substrate and the nature of the alkoxylation process, and upon the detailed conditions employed during the process. It has now been found that, for any given type of substrate and capping group, only certain alkoxy chain lengths are associated with suds-depressant capacity in conventional medium/high sudsing detergent compositions. The particular alkoxy chain lengths which are effective are determined by the HLB values of the corresponding components of the depressants; in particular, it has been found that these components must have an HLB value of less than 7.5, although the non-alkoxylated species which of course have lower HLB values than the alkoxylated species, are apparently unimportant from the point of view of suds-depressant action.

Accordingly, the detergent compositions of the invention contain at least 0.1%, based upon the weight of the detergent components, of alkoxylated suds-depressant surfactant having an HLB of less than 7.5. The suds-depressant and foaming detergent components are generally present at a weight ratio of at least about 1 to 20, while the alkoxylated components of the suds-depressant with HLB values of less than 7.5 generally constitute at least about 2% by weight of the total suds-depressing agent.

The HLB value of any particular component or group of components of the surface active agent may be determined experimentally according, for instance, to the procedure described in J.A.C.S., 50, 284–9, or it may be determined semi-empirically in the following manner. It is always possible, at least in principle, to write down the formula of a particular component of the capped surfactant as the condensation product of a precursor alkoxylated surfactant and an acidic species from which the capping acyl moiety is derived, i.e.

| | | | | |
|---|---|---|---|---|
| $R-Z-(AO)_x-AC$ (capped surfactant) | = | $R-Z-(AO)_x-H$ (precursor surfactant) | + $AcOH - H_2O$ (Capping acid) |

It should be noted that the above equation represents a formal equivalence only; it does not imply that the capped surfactant is necessarily prepared by acylation with an organic acid.

The determination of the HLB of the capped surfactant may now be approximately separated into two steps:

(1) Determination of the HLB of the precursor surfactant; and (2) Determination of the change in HLB upon acylation of the precursor surfactant, i.e.

| | | | | |
|---|---|---|---|---|
| $HLB_C$ (capped surfactant) | = | $HLB_P$ (precursor surfactant) | + | ΔHLB (increment for given capping acid) |

It is assumed that ΔHLB is a function of the identity of the capping acid only and is independent of the identity of the precursor surfactant.

In general, the precursor surfactants have been extensively studied, both experimentally and theoretically, and HLB data for these surfactants is now well documented (see, for instance, Becker "Emulsions Theory and Practice", Reinhold 1965, p. 233 and p. 248). Thus nonionic surfactants containing a hydrophilic polyethylene chain can be well described by the equation HLB = E/5 where E is the percentage by weight of ethylene oxide in the compound. In the case of nonionic surfactants which additionally comprise a polyol group (e.g., sorbitol), HLB values have similarly been expressed as HLB = (E + P)/5, where P is the percentage by weight of the polyol in the nonionic surfactant. HLB data for nonionic surfactants comprising alkylene oxide units other than ethylene oxide, e.g. mixtures of ethylene oxide and propylene oxide, may be determined using hydrophilicity values for EO and PO groups obtainable from standard tables. HLB values for various nonionic surfactants suitable as precursor surfactants in the present invention, are given in Table I. The values given are those for individual components of the nonionic surfactants in which each component has defined alkyl and ethoxyl chain length.

The HLB change, ΔHLB, upon capping the precursor surfactant may be estimated by applying the following semi-empirical equation:

$$\Delta HLB = -0.911 \times \log P_{OCT}(AcOH) - 0.687 \quad (2)$$

where $P_{OCT}(AcOH)$ is the partition coefficient for the capping acid between octanol and water.

A number of assumptions have been made in deducing equations (1) and (2), principally, the relationship between HLB and oil/water partition coefficients postulated by J. T. Davies, Second International Congress of Surface Activity, p. 434 (1957); the correlation between oil/water partition coefficients and octanol/water coefficients as set forth by A. Leo, C. Hansch and D. Elkins in *Chem. Rev.* 71, 525–616 (1971), and the additive/constitutive rules for log $P_{OCT}$ values for molecular groups, also described in the *Chem. Rev.* article and references cited therein.

Log $P_{OCT}$ values for the capping acid may be measured experimentally or determined theoretically according to the general methods and principles described in the *Chem. Rev.* article. The theoretical calculation of log $P_{OCT}$ for any particular molecule rests upon the basis that the presence of specific chemical groups in the molecule produces corresponding additive increments in the log $P_{OCT}$ value for the molecule. The log $P_{OCT}$ incremental value for any given group is denoted the $\pi$ value of the group and tables of $\pi$ values for commonly occurring constituent groups have been published. It is thus possible to calculate log $P_{OCT}$

TABLE I

| | HLB Values for Individual Components of Precursor Nonionics | | |
|---|---|---|---|
| | $C_{.10}$ | $C_{12}$ | $C_{j\,14.5}$ |
| $E_1$ | 4.4 | 3.8 | 3.3 |
| $E_2$ | 7.2 | 6.4 | 5.7 |
| $E_3$ | 9.1 | 8.3 | 7.5 |
| $E_4$ | 10.5 | 9.7 | 8.9 |
| $E_5$ | 11.6 | 10.8 | 10.0 |
| $E_6$ | 12.5 | 11.7 | 10.9 |

values for the commonly occurring aliphatic and aromatic acids, and the increment in HLB on acylating the terminal hydroxyl groups of the nonionic surfactant may be simply determined by application of equation (2). Theoretical values of log $P_{OCT}$ and ΔHLB for a number of capping acids are given in Table II. Experimental values of log $P_{OCT}$ are also given where available, the references for the experimental work being cited in the *Chem. Rev.* (1971) article. The detailed results of some of the older experimental work have been questioned recently so that this data should be treated with some caution. Where the capped surfactants comprise molecular groups whose hydrophilicity depends upon pH, log $P_{OCT}$ and HLB values should of course be measured at the pH of use, e.g., the pH of a 0.5% by weight aqueous solution of the composition in question.

TABLE II

| Acid | Log $P_{OCT}$ and ΔHLB Values For Various Capping Acids: Experimental Value of Log $P_{OCT}$ | Theoretical Value of Log $P_{OCT}$ | ΔHLB* |
|---|---|---|---|
| Acetic | −0.17 | −0.15 | −0.55 |
| Bromo acetic | +0.41 | +0.45 | −1.10 |
| Hydroxy acetic | −1.11 | −1.27 | +0.47 |
| Methoxy acetic | — | −0.63 | −0.11 |
| Propanoic | +0.33 | +0.35 | −1.01 |
| Maleic | — | −0.57 | −0.17 |
| Crotonic | +0.72 | +0.58 | −1.22 |
| Butanoic | +0.79 | +0.85 | −1.46 |
| 2-Hydroxy-2-methyl propanoic | −0.36 | −0.67 | −0.08 |
| Lerutinic | — | −0.36 | −0.36 |
| Hexanoic | +1.88 | +1.85 | −2.37 |
| Benzoic | +1.87 | +1.85 | −2.37 |

*ΔHLB values based upon theoretical log $P_{OCT}$ values.

Thus, once the chemical constitution of a capped surfactant is known, it is quite straight forward to determine the corresponding HLB data using the principles described above. In turn, the chemical constitution of the surfactant, in particular its alkyl and alkoxy chain length distribution, may be readily determined by, for instance, gas chromatographic analysis of the surfactant making due allowance for variation in the response factor of the chromatographic column for different components of the surfactant by pre-calibration of the column. Typical distributions of ethylene oxide content of several commercial ethoxylated primary alcohol blends, known as Neodol and Dobanol ethoxylate blends, sold respectively by the Shell Chemical Co. and Shell International Chemicals Ltd., are given in Table III.

TABLE III

| Weight % Ethoxylate | $C_{12-13}$ Alcohol Ethoxylate 1 | 2 | $C_{9-11}$ Alcohol Ethoxylate 3 | 4 | $C_{14-15}$ Alcohol Ethoxylate 5 |
|---|---|---|---|---|---|
| $E_0$ | 15.8 | 6.4 | 16.5 | 7.4 | 2.3 |
| $E_1$ | 10.6 | 4.7 | 11.5 | 5.5 | 1.6 |
| $E_2$ | 12.2 | 6.3 | 13.4 | 7.4 | 2.6 |
| $E_3$ | 12.2 | 7.8 | 13.2 | 9.1 | 3.6 |
| $E_4$ | 10.6 | 8.9 | 12.4 | 10.0 | 5.0 |
| $E_5$ | 8.6 | 9.4 | 10.1 | 10.9 | 6.3 |
| $E_6$ | 6.4 | 9.4 | 7.8 | 9.9 | 7.8 |
| $E_7$ | 5.2 | 9.0 | 5.8 | 9.0 | 8.8 |
| $E_8$ | 4.1 | 8.2 | 3.6 | 7.8 | 8.7 |
| $E_9$ | 3.2 | 7.1 | 2.3 | 6.5 | 8.5 |
| $E_{10}$ | 2.5 | 6.0 | 1.6 | 5.1 | 8.2 |
| $E_{11}$ | 2.0 | 4.8 | 0.7 | 3.9 | 7.8 |
| $E_{12}$ | 1.4 | 3.7 | 0.5 | 2.8 | 6.7 |
| $E_{13}$ | 1.3 | 2.7 | 0 | 1.9 | 5.8 |
| $E_{14}$ | 1.1 | 1.8 | 0 | 1.2 | 16.3 |
| Others | 3.4 | 3.8 | 0 | 2.3 | |
| E average | 3.0 | 4.9 | 2.5 | 4.32 | 7.0 |
| HLB average | 8.6 | 10.55 | 8.1 | 10.7 | 11.6 |

The preferred capped surfactants have an average degree of alkoxylation in the range from 0.5 to 7, desirably from 1 to 5, with at least 4½%, preferably at least 10%, desirably at least 15% and especially at least 50% of the capped surfactant being alkoxylated with an HLB of less than 7.5. Preferably the polyalkoxy moiety will be a homopolyethoxy chain. Suitable examples include capped surfactants in which:

(1) R comprises, on average, between 9 and 11 carbon atoms, AcOH has a log P greater than −1.0, and in which at least 4½% by weight of the surfactant has $x$ equal to 1 or 2.

(2) Capped surfactants in which R comprises, on average, between 11 and 13 carbon atoms, AcOH has a log P greater than −1.9 and in which at least 4½% by weight of the suds-depressing surfactant has $x$ equal to 1 or 2.

(3) Capped surfactants in which R comprises, on average, between 11 and 13 carbon atoms, AcOH has a log P greater than 0.12, and in which at least 4½% by weight of the suds depressing surfactant has $x$ equal to 1, 2 or 3.

(4) Capped surfactants in which R comprises, on average, between 14 and 16 carbon atoms, AcOH has a log P greater than −0.75, and in which at least 4½% by weight of the suds depressing surfactant has $x$ equal to 1, 2 or 3.

The suds-depressants may be made from alcohol, thio and amine precursors by conventional alkoxylation and esterification procedures. The preferred surfactants are prepared from primary alcohols which are either linear (such as those derived from natural fats or prepared by the Ziegler process from ethylene, e.g. myristyl, cetyl, stearyl alcohols), or partly branched such as Dobanols which are understood to have about 25% 2-methyl branching (Dobanol is a Tradename of Shell) or Synperonics, which are understood to have about 50% 2-methyl branching (Synperonic is a Tradename of I.C.I.). A particularly preferred ethoxy alcohol is sold as Dobanol 45-4. Other hydrophobic groups may also be employed, such as $C_{3-18}$ fatty acyl groups, or alkyl phenol groups with $C_{6-12}$ alkyl groups, or condensation products of propylene oxide with propyleneglycol having a molecular weight of about 1500 to 1800, or condensation products of propylene oxide with ethylene diamine having a molecular weight of about 2500 to 3000.

A suitable method of alkoxylation of the hydrophobic alcohol involves adding to the alcohol or mixture of alcohols a calculated amount, e.g. from about 0.1% by weight to about 0.6% by weight, preferably from about 0.1% by weight to about 0.4% by weight, based on total alcohol of a strong base, typically an alkali metal hydroxide such as sodium hydroxide or potassium hydroxide which serves as catalyst for the alkoxylation. The resulting mixture is dried, as by vapor phase removal of any water present, and an amount of alkylene oxide calculated to provide preferably from about 0.5 to 7 moles of alkylene oxide per mole of alcohol is then introduced and the resulting mixture is allowed to react until the alkylene oxide is consumed, the course of the reaction being followed by the decrease in reaction pressure.

The alkoxylation is conducted at an elevated temperature and pressure. Suitable reaction temperatures are from 120° C to about 220° C with the range of from about 140° C to about 160° C being preferred. A suitable reaction pressure is achieved by introducing to the reaction vessel the required amount of e.g. ethylene oxide, which has a high vapor pressure at the desired reaction temperature. The pressure serves as a measure of the degree of reaction and the reaction is considered to be substantially complete when the pressure no longer decreases with time.

If desired, the alkoxylated alcohol may be further processed in order to increase the proportion of sub 7.5 HLB components in the overall distribution. Such further processing may take the form of fractional distillation, fractional solubilization or gel filtration. Such further processing may be desirable if the average degree of alkoxylation is greater than about 7.5.

Methods are also well known for the direct preparation of alkoxylated surfactants having a very narrow spread in the range of alkoxylate chain length in the surfactant. For instance, polyglycols of specific chain length are commercially available and may be added to an alkyl moiety by a nucelophilic substitution reaction of the monosodium salt of the pure polyglycol on the alkyl iodide or on the p-toluenesulfonyl ester of the aliphatic alcohol. The pure polyglycol may be made from the corresponding alkylene oxide by catalytic stepwise addition to form a polyalkyleneglycol, followed by fractionation of the various glycol chain lengths, adjacent members of the glycol series differing in boiling point by about 20°. In this way, short alkoxy chain length members may be prepared in substantially pure form directly from commercially available materials. Alternatively, a suitable low number of alkylene oxide units may be polymerized and the resulting polyethylene glycol may be added directly to the primary alcohol, via the tosylate of the latter, without fractionating the polyethyleneglycol into its component chain lengths. In other embodiments, the alkylene oxide is reacted with the alcohol by stepwise addition using an acid catalyst, e.g. antimony pentachloride, stannic chloride or boron trichloride. Acid catalysts is preferably performed where the average degree of polymerization of the polyether chain is 6 or less. It may still be used when the average degree of polymerization is greater than 6, but the manufacturing process will then preferably include a fractioning step to increase the proportion of sub 7.5 HLB components in the total surfactant.

Capped surfactants may also be made from thiol and amine precursors, although the alcohol derivatives described above are preferred for their suds depressant action. Suitable alkoxylated surfactants include alkoxylated amines, alkoxylated quaternary ammonium compounds and alkoxylated amides. Different types of acid capping groups may also be employed, for example sulfonate and sulfate esters, phosphinate, phosphonate and phosphate esters. Preferably, however, the capping group is a monobasic carboxylic acid such as acetic acid, propionic acid, butyric acid, methacrylic acid, etc.

The capped surfactants are readily prepared from the corresponding precursor surfactants by transesterification or by acylation with a suitable acylating agent, for example, an acid anhydride or halide or, in the case of the acetate esters, with ketene. The anhydride route is the most conventional process which simply entails the direct reaction of the precursor surfactant with a small molar excess of the acid anhydride at about 110°–120° C for about one-half to 1 hour, followed by hydrolysis of the excess anhydride with water and neutralization of the liberated acid. The capped surfactant salts itself out of the aqueous solution and is separated. Alternately, the separate neutralization and separation stages may be omitted and the aqueous surfactant/acid mixture may be added directly to the detergent composition at the crutcher stage. Neutralization of excess acid takes place in the crutcher producing a low level of sodium acetate which is incorporated in the detergent composition in place of the conventional sodium sulfate. Alternatively, the surfactant/acid mixture may be sprayed directly onto an alkaline granular detergent matrix, thereby neutralizing excess acid.

Surfactant materials which may be used in the compositions of the invention can be selected from water-soluble soap and synthetic anionic, nonionic, cationic, zwitterionic and amphoteric detergents described below. Preferably, the surfactants are nonionics, zwitterionics or soaps, or combinations thereof with anionics. The capped surfactants have a somewhat smaller suds depressant action in compositions based upon anionic synthetic detergents as the sole organic surfactant.

The detergent will generally be present in amounts of between 0.5% and 95% by weight of the composition, preferably from 2% to 40% by weight in the case of a granular detergent, and from 10% to 60% by weight in the case of a liquid detergent composition. Automatic dishwashing compositions and hard surface cleaners may contain as little as 5% detergent or even lower. In detergent compositions, a considerable degree of suds depression is achieved with a weight ratio of total capped surfactant to detergent to about 1:20 upwards, preferably at least 1:12, which can give products suitable for most front loading machines. When the ratio reaches 1:6, products are obtained giving well controlled suds even in Europe washing machines operated at the highest temperatures (about 95° C); and when the ratio reaches about 1:3 substantially zero suds can be obtained even in these severe conditions with a nonionic based detergent composition. Ratios of at least 1:6, especially at least 1:3 are preferred. This corresponds to a level of total capped surfactant in the finished product of between about 1% and 5% of the weight of the product.

A. Anionic Soap and Non-Soap Synthetic Detergents

The preferred class of detergents for use in the present invention is the alkali soap class including the sodium, potassium, ammonium, alkylammonium and alkylolammonium salts of fatty acids containing from 8 to 24 carbon atoms and preferably from 10 to 20 carbon atoms. Suitable fatty acids can be obtained from natural sources, such as plant or animal esters (e.g., palm oil, coconut oil, babassu oil, soybean oil, castor oil, tallow, whale and fish oils, grease, lard and mixtures thereof). The fatty acids also can be synthetically prepared (e.g. by the oxidation of petroleum or by hydrogenation of carbon monoxide by the Fischer Tropsch process). Resin acids are suitable, such as rosin and those resin acids in tall oil. Napthenic acids are also suitable. Sodium and potassium soaps can be made by direct saponification of the fats and oils by the neutralization of the free fatty acids which are prepared in a separate manufacturing process. Particularly useful are the sodium, potassium and triethanolammonium salts of the mixtures of fatty acids derived from coconut oil and tallow, e.g. sodium or potassium tallow and coconut soaps.

This class of detergents also includes water-soluble salts, particularly the alkali metal salts, of organic sulfuric reaction products having in their molecular structure an alkyl radical containing from 8 to 22 carbon atoms and a sulfonic acid of sulfuric acid ester radical. (Included in the term alkyl is the alkyl portion of higher acyl radicals.) Examples of this group of synthetic detergents are the alkali metal, e.g. sodium or potassium, alkyl sulfates, especially those obtained by sulfating the higher alcohols (8 to 18 carbon atoms) produced by reducing the glycerides of tallow or coconut oil; the alkali metal olefin sulfonates of from 8 to 24 caarbon atoms described, for example, in U.S. Pat. No. 3,332,880; and the alkali metal alkyl glyceryl ether sulfonates especially those ethers of the higher alcohols derived from tallow and coconut oil. Other anionic detergents include the alkali metal alkylbenene sulfonates, in which the alkyl group contains from 9 to 15 carbon atoms, including those of the types described in U.S. Pat. Nos. 2,220,099 and 2,477,383 (the alkyl radical can be a straight or branched aliphatic chain); sodium coconut oil fatty acid monoglyceride sulfates and sulfonates; salts of alkyl phenol ethylene oxide ether sulfates with 1 to 12 units of ethylene oxide per molecule and in which the alkyl radicals contain from 8 to 18 carbon atoms; the reaction product of fatty acids esterified with isethionic acid and neutralized with sodium hydroxide where, for example, the fatty acid is oleic or derived from coconut oil; sodium or potassium salts of fatty acid amine of a methyl tauride in which the fatty acids, for example, are derived from coconut oil; sodium potassium $\beta$-acetoxy or $\beta$-acetamido alkanesulfonates where the alkane has from 8 to 22 carbon atoms; and others known in the art. A number are specifically set forth in U.S. Pat. Nos. 2,286,921; 2,486,922; and 2,396,278.

Other synthetic anionic detergents useful herein are alkyl ether sulfates. These materials have the general formula $R^5O(C_2H_4O)_nSO_3M$, wherein $R^5$ is alkyl or allkenyl of 8 to 24 carbon atoms, $n$ is 1 to 30, and M is a salt-forming cation selected from alkali metal, ammonium and dimethyl-, trimethyl-, triethyl-, dimethanol-, diethanol-, trimethanol- and triethanol-ammonium cations.

The alkyl ether sulfates are condensation products of ethylene oxide and monohydric alcohols having from 8 to 24 carbon atoms. Preferably, $R^5$ has 14 to 18 carbon atoms. The alcohols can be derived from fats, e.g. coconut oil or tallow, or can be synthetic. Lauryl alcohol and straight-chain alcohols derived from tallow are preferred herein. Such alcohols are reacted with from 1 to 12, especially 6, molar proportions of ethylene oxide and the resulting mixture of molecular species, having, for example an average of 6 moles of ethylene oxide per mole of alcohol, is sulfated and neutralized.

Specific examples of alkyl ether sulfates useful in the present invention are sodium coconut alkyl ethylene glycol ether sulfate; lithium tallow alkyl triethylene glycol ether sulfate; and sodium tallow alkyl hexaoxyethylene sulfate. Preferred herein for reasons of excellent cleaning properties and ready availability are the alkali metal coconut- and tallow-alkyl oxyethylene ether sulfates having an average of 1 to 10 oxyethylene moieties per molecule. The alkyl ether sulfates are described in U.S. Pat. No. 3,332,876.

B. Nonionic Synthetic Detergents

Nonionic synthetic detergents may be broadly defined as compounds produced by the condensation of alkylene oxide groups (hydrophilic in nature) with an organic hydrophobic compound, which may be aliphatic or alkyl aromatic in nature. The length of the hydrophilic or polyoxyalkylene radical which is condensed with any particular hydrophobic group can be readily adjusted to yield a water-soluble compound having the desired degree of balance between hydrophilic and hydrophobic elements.

For example, a well known class of nonionic synthetic detergents is made available on the market under the tradename of "Pluronic". These compounds are formed by condensing ethylene oxide with a hydrophobic base formed by the condensation of propylene oxide with propylene glycol. The hydrophobic portion of the molecule which, of course, exhibits water-insolubility, has a molecular weight of from 1500 to 1800. The addition of polyethylene radicals to this hydrophobic portion tends to increase the water solubility of the molecule as a whole and the liquid character of the product is retained up to the point where the polyethylene content is about 50% of the total weight of the condensation product.

Other suitale nonionic synthetic detergents include the following:

1. The polyethylene oxide condensates of alkyl phenol, e.g. the condensation products of alkyl phenols having an alkyl group containing 6 to 12 carbon atoms in either a straight-chain or branched-chain configuration, with ethylene oxide, the said ethylene oxide being present in amounts equal to 5 to 25 moles of ethylene oxide per mole of alkyl phenol. The alkyl substituent in such compounds may be derived for example, from polymerized propylene, diisobutylene, octene or nonene.
2. Those derived from the condensation of ethylene oxide with the product resulting from the reaction of propylene oxide and ethylene diamine. For example, compounds containing from 40% to 80% polyoxyethylene by weight and having a molecular weight of from 5,000 to 11,000 resulting from the reaction of ethylene oxide groups with a hydrophobic base constituted of the reaction product of ethylene diamine and excess propylene oxide. Said basis having a molecular weight of the order of 2,500 to 3,000 are satisfactory.
3. The condensation product of aliphatic alcohols having from 8 to 24 carbon atoms, in either straight-chain or branched-chain configuration with ethylene oxide, e.g. a coconut alcohol-ethylene oxide condensate having from 5 to 30 moles of ethylene oxide per mole of coconut alcohol, the coconut alcohol fraction having from 10 to 14 carbon atoms.
4. Nonionic detergents include nonyl phenol condensed with either about 10 or about 30 moles of ethylene oxide per mole of phenol and the condensation products of coconut alcohol with an average of either about 5.5 or about 15 moles of ethylene oxide per mole of alcohol and the condensation product of about 15 moles of ethylene oxide with one mole of tridecanol. Other examples include dodecylphenol condensed with 12 moles of ethylene oxide per mole of phenol; dinonylphenol condensed with 15 moles of ethylene oxide per mole of phenol; dodecyl mercaptan condensed with 10 moles of ethylene oxide per mole of mercaptan; bis-(N-2-hydroxyethyl) lauramide; nonyl phenol condensed with 20 moles of ethylene oxide per mole of nonyl phenol; myristyl alcohol condensed with 10 moles of ethylene oxide per mole of myristyl alcohol; lauramide condensed with 15 moles of ethylene oxide per mole of lauramide and di-isooctylphenol condensed with 15 moles of ethylene oxide.
5. A detergent having the formula $R^6R^7R^8N \rightarrow O$ (amine oxide detergent) wherein $R^6$ is an alkyl group containing from 10 to 28 carbon atoms, from 0 to 2 hydroxy groups and from 0 to 5 ether linkages, and $R^7$ and $R^8$ are each selected from alkyl radicals and hydroxyalkyl radicals containing from 1 to 3 carbon atoms. Specific examples of amine oxide detergents include: dimethyldodecylamine oxide, dimethyltetradecylamine oxide, ethylmethyltetradecylamine oxide, cetyldimethylamine oxide, dimethylstearylamine oxide, cetylethylpropylamine oxide, diethyldodecylamine oxide, diethyltetradecylamine oxide, dipropyldodecylamine oxide, bis-(2-hydroxyethyl)dodecylamine oxide, bis-(2-hydroxyethyl)-3-dodecoxy-1-hydroxypropylamine oxide, (2-hydroxypropyl)-methyltetradecylamine oxide, dimethyloleylamine oxide, dimethyl-(2-hydroxydodecyl)amine oxide, and the corresponding decyl, hexadecyl and octadecyl homologues of the above compounds.

6. A detergent having the formula

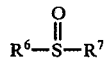

wherein $R^6$ and $R^7$ are as defined above. Specific examples of sulfoxide detergents include dodecyl methyl sulfoxide, tetradecyl methyl sulfoxide, 3-hydroxytridecyl methyl sulfoxide, 3-methoxytridecyl methyl sulfoxide, 3-hydroxy-4-dodecoxybutyl methyl sulfoxide, octadecyl-2-hydroxyethyl sulfoxide and dodecylethyl sulfoxide.

7. The ammonia, monoethanol and diethanol amides of fatty acids having an acyl moiety of from 8 to 18 carbon atoms. These acyl moieties are normally derived from naturally occurring glycerides, e.g. coconut oil, palm oil, soybean oil and tallow but can be derived synthetically, e.g. by the oxidation of petroleum, or by hydrogenation of carbon monoxide by the Fischer Tropsch process.

C. Ampholytic Synthetic Detergents

Ampholytic synthetic detergents can be broadly described as derivatives of aliphatic or aliphatic derivatives of heterocyclic secondary and tertiary amines, in which the aliphatic radical may be straight-chain or branched and wherein one of the aliphatic substituents contain from 8 to 18 carbon atoms and at least one contains an anionic water-solubilizing group, e.g. carboxy, sulfo or sulfato. Examples of compounds falling within this definition are sodium 3-(dodecylamino)-propionate; sodium 3-(dodecylamino)propane-1-sulfonate, sodium 2-(dodecylamino)-ethylsulfate, sodium 2-(dimethylamino)-octadecanoate, disodium 3-N-carboxymethyl dodecylamino)-propane-1-sulfate, disodium octadecyl-iminodiazetate, sodium 1-carboxymethyl-2-undecyl imidazole, and sodium N,N-bis-(2-hydroxyethyl)-2-sulfato 3-dodecoxypropylamine.

D. Zwitterionic Synthetic Detergents

Zwitterionic synthetic detergents can be broadly described as derivatives of aliphatic quaternary ammonium and phosphonium or tertiary sulfonium compounds in which the cationic atom may be part of a heterocyclic ring, and in which the aliphatic radical may be straight-chain or branched and wherein one of the aliphatic substituents contains from 3 to 18 carbon atoms, and at least one aliphatic substituent contains an anionic water-solubilizing group, e.g. carboxy, sulfo or sulfato.

Preferably, the zwitterionic detergent has the general formula

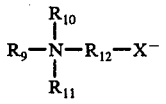

in which $R_9$ is an alkyl, alkenyl or hydroxyalkyl group having 12 to 18 carbon atoms, $R_{10}$ and $R_{11}$ are alkyl or hydroxyalkyl groups having 1 or 2 carbon atoms, $R_{12}$ is an alkylene group having 1 to 6 carbon atoms optionally substituted in the 2 position relative to X by a hydroxyl group, and X is $SO_3$, $OSO_3$ or $CO_2$.

Examples of compounds falling within this definition are 3-(N,N-dimethyl-N-hexadecylammonio)-2-hydroxypropane-1-sulfonate, 3-(N,N-dimethyl-N-hexadecylammonio)propane-1-sulfonate, 2-(N,N-dimethyl-N-dodecylammonio)acetate, 3-(N,N-dimethyl-N-dodecyolammonio)propionate, 2-(N,N-dimethyl-N-octadecylammonio)-ethyl sulfate, 3-(N,N-bis-(2-hydroxyethyl)-N-octadecylammonio)-2-hydroxypropane-1-sulfonate and 3-(N,N-dimethyl-N-1-methylalkylammonio)-2-hydroxypropane sulfonate, wherein the alkyl group averages 13.5 to 14.5 carbon atoms in length. Some of these detergents are described in U.S. Pat. Nos. 2,129,264; 2,178,353; 2,774,786; 2,813,898 and 2,828,332.

E. Cationic Detergents

Cationic detergents include those having the formula

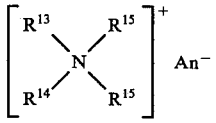

wherein $R^{13}$ is an alkyl chain containing from 8 to 20 carbon atoms, each $R^{15}$ is selected from alkyl and alkanol groups containing from 1 to 4 carbon atoms and benzyl groups, there being normally no more than one benzyl group, and two $R^{15}$ groups can be joined by either a carbon-carbon ether, or imino linkage to form a ring structure, $R^{14}$ is selected from one of the groups represented by $R^{13}$ and $R^{15}$, and An represents a halogen sulfate, nitrate, phosphate, acetate or methylsulfate group. Specific examples are coconut alkyl trimethyl amine chloride, dedecyl dimethyl benzyl bromide, dodecyl methyl morpholino chloride and ditallow dimethyl ammonium chloride. The cationic surfactant will generally be present only in combination with an auxiliary anionic, zwitterionic or nonionic detergent.

The composition of the invention may contain, in addition to the capped surfactant and organic detergent compounds, all manner of detergency builders commonly taught for use in detergent compositions. Such builders may be used at concentrations of from about 5% to about 90% by weight, preferably from about 10% to about 80% by weight and most preferably 25% to about 70% by weight, of the composition.

Suitable inorganic detergency builders include water-soluble salts of pyrophosphates, orthophosphates, polyphosphates, phosphonates, carbonates, bicarbonates and silicates. Specific examples of inorganic phosphate builders include sodium and potassium tripolyphosphates, pyrophosphates and hexametaphosphates. Detergent compositions incorporating pyrophosphate builders from the subject of the commonly assigned copending applications U.S. Ser. Nos. 587,455; 550,054 and 550,055.

The polyphosphonates specifically include, for example, the sodium and potassium salts of ethylene diphosphonic acid, the sodium and potassium salts of ethane 1-hydroxy-1,1-ethane-1,1,2-triphosphonic acid. Examples of these and other phosphorous builder compounds are disclosed in U.S. Pats. Nos. 3,159,581; 3,213,030; 3,422,021; 3,422,137; 3,400,176 and 3,400,148.

Non-phosphorus-containing builder salts such as the alkali metal carbonates, bicarbonates and silicates may also be used.

Water-soluble organic builders which may be used include the alkali metal, ammonium and substituted ammonium polyacetates, carboxylates, polycarboxylates and polyhydroxysulfonates. Specific examples of the polyacetate and polycarboxylic builder salts include sodium, potassium, lithium, ammonium and substituted ammonium salts of ethylene diamine tetracetic acid, nitrilotriacetic acid, oxydisuccinic acid, mellitic acid, benzene polycarboxylic acids, and citric acid.

Preferred examples of polycarboxylate builders, as set forth in U.S. Pat. No. 3,308,067, include the water-soluble salts of homo- and co-polymers of aliphatic carboxylic acids such as maleic acid, itaconic acid, mesaconic acid, fumaric acid, aconitic acid, citraconic acid and methylenemalonic acid.

Additional preferred builders include the water-soluble salts, especially sodium and potassium salts, of carboxymethyloxymalonate, carboxymethyloxysuccinate, ciscyclohexanehexacarboxylate, ciscyclopentanetetracarboxylate and phloroglucinol trisulfonate.

A further useful class of detergency builder materials are insoluble aluminosilicates, particularly those disclosed in Belgian Pat. No. 814,874. This discloses and claims detergent compositions containing sodium aluminosilicates of the formula $Na(AlO_2)_z(SiO_2)_yxH_2O$, wherein $z$ and $y$ are integers of at least 6, the molar ratio of $z$ to 6 is in the range from 1.0:1 to about 0.5:1 and $x$ is an integer from about 15 to about 264, said aluminosilicates having a calcium ion exchange capacity of at least 200 mg. eq./gr. and a calcium ion exchange rate of at least about 2 grains/gallon/minute/gram. A preferred material is $Na_{12}(SiO_2.AlO_2)_{12}.27\ H_2O$.

Another type of detergency builder material useful in the present compositions comprises a water-soluble material capable of forming a water-insoluble reaction product with water hardness cations in combination with a crystallization seed which is capable of providing growth sites for the reaction product. Builder materials of this type are disclosed in Belgian Pat. No. 798,856.

The compositions can optionally contain all manner of additional materials commonly found in laundering and cleaning compositions. Specifically, oxidizing bleaches such as sodium perborate, sodium percarbonate, optionally with bleach precursors such as phthalic anhydride, tetra acetyl ethylene diamine, tetra acetyl methylene diamine or tetra acetyl glycoluril may be incorporated at levels of 1% to 25% of the composition.

Viscosity and anticaking aids such as sodium salts of lower alkyl aromatic sulfonic acids are conveniently employed at levels of 0.5% to 5%, particularly if anionic surfactants are used as part of the surfactant mixture. Other useful, anticaking ingredients include the alkali metal salts of $\alpha$-sulfosuccinic acid and benzene sulfonic acid.

Soil suspending agents such as sodium carboxymethylcellulose and hydroxyethylcellulose may also be used in amounts of 0.25% to 5% by weight. Other suitable materials useful for this purpose include copolymers of maleic anhydride with ethylene of methyl vinyl ether and certain polymeric glassy metaphosphates.

Enzymes such as the proteolytic enzymes sold under the tradenames "Alcalase" and "Esterase" (Novo Industries A/S, Denmark) Maxatase and AZ-Protease (Gist-Brocades NV The Netherlands) may be incorporated at levels of up to 1% by weight, preferably from 0.25% to 0.75% by weight. Such enzymatic materials may be coated or prilled to aid their stability and to minimize the formation of dust during processing and subsequent storage.

Typical examples of granular compositions in accordance with the present invention comprise by weight of the composition: 2%–30%, preferably 10%–25% and most preferably 15%–20% total surfactant; 10%–80%, preferably 25%–70% by weight of a detergent builder salt; and 15%–50% of other optional ingredients such as bleaches, viscosity and anticaking aids, anti-redeposition agents, fluorescers, fabric conditioning agents, oil-solubilizing agents water insoluble solvents and surfactants, enzymes, perfumes, colors and anti-bacterial agents.

The composition of the invention may be prepared by incorporating the capped surfactant/detergent mixture in a liquid or solid carrier which in turn is combined with the optional ingredients as previously discussed. Liquid carriers include water and water-alcohol mixtures, e.g. 90:10 (wt.) water-ethanol; 80:20 (wt.) water:n-propanol; 70:30 (wt.) water-isopropanol; 95:5 (wt.) water-n-butanol, and the like. Water-ethanol mixtures at weight ratios of water:ethanol of 95:5 to 1:1 are especially preferred liquid carriers.

Typical liquid detergent compositions embodying the present invention comprise (by weight of the composition) 5%–50%, preferably 20%–40% and most preferably 25%–35% of an alcohol ethoxylate, 1% to 12% preferably 2% to 6% of a capped alcohol ethoxylate, and 5% to 35%, preferably 10% to 30%, and most preferably 10% to 20% of a salt of an anionic surfactant for example an oleate. In a preferred embodiment, a source of alkalinity is included at a level sufficient to raise the pH to a value of at least 7.0. For this purpose, free base should be added in excess of that necessary to provide the cation for the anionic surfactant. Any source of free alkalinity can be employed but preferred materials are sodium and potassium hydroxide and alkanolamines. Usage of the latter is normally 1% to 20%, preferably 2% to 25% and most preferably 5% to 10% by weight of the composition.

Solid, sorbent carriers for capped surfactant/nonionic detergent mixtures include any of the water-soluble solid builder materials described above, as well as water-insoluble solids such as the microfine silicas, clays, kieselguhr, vermiculites and the like. The surfactant mixtures are sorbed on such solid carriers at a weight ratio of surfactant: carrier from about 1:20 to 20:1 for use in dry detergent compositions. A carrier which is particularly suitable for use in preparing spray-dried nonionic detergent granules is Kaolinite clay, as disclosed in U.S. Ser. No. 589,116.

Granular compositions embodying nonionic detergent/capped nonionic mixtures of the present invention can also be prepared by agglomeration techniques and by use of carrier-type stems in which the nonionic mixture is incorporated by spraying or blending with a portion of absorbent granules that are subsequently mixed with the remainder of the detergent formulation. Such absorbent granules may either be specially formulated or may be part of the spray-dried product. A particularly preferred carrier granule comprising a low level (about 1%) of a granulating aid such as an anionic surface-active agent is described in British Patent Application 16164/74. Suitably, the anionic surface-active agent is a sodium, potassium or ammonium alkyl benzene sulfonate having 11 to 13 carbon atoms in the alkyl residue.

EXAMPLES I TO VI

Examples I to VI were prepard using Dobanol 45-7 acetate as the suds-depressant. The compositions of the various formulations are detailed in Table IV. The sudsing characteristics of the formulations were determined in two types of sudsing tests, in the following manner.

1. Minidrum Sudsing Test

A 200 g. load of clean terry towels and a 150 g. load of clean tea towels were placed together in each of the minidrums and 3½ liters of water at 55° C and 18° Hardness were added followed by 17.5 g. of the test composition to give a product concentration of 0.5%. The drums were periodically agitated for a time of 16 seconds with intervals of 6 seconds between the agitation periods. Simultaneously, the water temperature was raised from 55° C to 85° C over a period of 20 minutes and the temperature was then maintained at 85° C for a further 10 minutes. The height of suds in each minidrum was measured at 5 minute intervals during the course of the experiment, readings, measured in inches, being taken at each side of the drum towards the end of a 16 second agitation period. In this way, the average suds height at a particular temperature was obtained and the whole procedure replicated at least 6 times for each product. A profile of suds height against temperature was then drawn, and the maximum suds height, maximum suds heigh temperature and suds collapse temperature were found.

2. Laundry Sudsing Test — U.K. Conditions

This test was performed in the Hoover Matchbox domestic front-loading automatic washing machine using the $B_3$ cycle (85° C) in both hard (18° H) and soft (2° H) water conditions. Six oz (170 g.) of product was used for the hard water runs and 3.1 oz (88 g.) was used for the soft water runs. An 8 lb. load consisting of two double cotton sheets, one single sheet, six tea towels and six terry towels, all of which had been naturally soiled in the home, were washed in each case. The suds height was measured in inches at 5 minute intervals during the course of the experiment and at least five replicates were performed. A profile of average suds height against temperature was then drawn and the maximum suds height was recorded.

The cleaning performance of the compositions of Examples I to VI was determined as follows:

Cleaning Tests

Cleaning tests were performed on artifically soiled cotton and polyester cotton swatches. Three types of soil were studied, dirty motor oil (DMO), dyed olive oil (DCO) and krefeld. The swatches were washed for 10 minutes in a Tergotometer at 0.5 percent product concentration in soft water (2° H) and at a specific temperature (generally 50°, 60°, or 85° C), and the percentage stain removal was determined by reflectance measurements in the usual way.

Sudsing and cleaning data obtained by the above tests for Examples I to VI is tabulated in Table IV. Comparing Examples I to III was Standards I and IV, it may be seen that Dobanol 45- 7 acetate depresses the suds of Dobanol 45-7 to a degree greater than one would predict simply on a weight ratio basis. This is a characteristic feature of a suds depressant and shows that Dobanol 45-7 acetate is a particularly effective depressant for Dobanol 45-7 at a weight ratio of 1:2 and above.

Moreover, it may be seen that the capped nonionic exerts its maximum suds depressant action at high temperatures, i.e., at temperatures above the so-called suds collapse temperature (defined here as the temperature at which the suds are depressed to a level of 1 inch or lower). The suds collapse temperature varies from one composition to another and depends upon the detailed conditions of the wash process, but in the minidrum test, Dobanol 45-7 acetate compositions have suds collapse temperatures in the 50°–60° C range. The high temperature region is precisely the region in which conventional suds-depressants are lease effective so that the value of the acyl capped surfactants of the present invention is readily apparent.

The capped surfactants of the present invention are generally less effective as suds depressants for LAS than for nonionic surfactants, but Example IV and V illustrate that they are still valuable. Example VI similarly shows the usefulness of Dobanol 45-7 acetate as a suds depressant combination with a typical zwitterionic surfactant and illustrates that the capped nonionic may be used to partially or totally replace the conventional nonionic in nonionic/zwitterionic detergent compositions so as to render them compatible with front loading automaicseven under high temperatures, "boil-wash" conditions.

The relative cleansing performance of the composition varies a little according to the type of stain and fabric, but on the average it is found that capping Dobanol 45-7 with an acetate group makes little, if any, significant difference to the cleaning performance of the compositions on DMO, DOO, and krefeld stains.

SUDSING AND CLEANING PERFORMANCE OF DOBANOL 45-7 ACETATE COMPOSITIONS

| | EXAMPLES | | | | | | STANDARDS | | | |
|---|---|---|---|---|---|---|---|---|---|---|
| Composition | I | II | III | IV | V | VI | I | II | III | IV |
| Dobanol 45-7 Acetate | 4 | 6 | 8 | 6 | 12 | 6 | | | | 12 |
| Dobanol 45-7 | 8 | 6 | 4 | 6 | | | 12 | 12 | 6 | |
| LAS* | | | | 1 | 1 | | | 1 | | |
| $C_{14-8}$ HAPS** | | | | | | 6 | | | 6 | |
| Sodium Sulphate | 12 | 22 | 22 | 11 | 21 | 12 | 12 | 11 | 12 | 12 |
| Sodium Silicate | 6 | 6 | 6 | 6 | 6 | 6 | 6 | 6 | 6 | 6 |
| Sodium Tripolyphosphate | 33 | 33 | 33 | 33 | 33 | 33 | 33 | 33 | 33 | 33 |
| Sodium Perborate | 25 | 25 | 25 | 25 | 25 | 25 | 25 | 25 | 25 | 25 |

*LAS is Sodium Linear Alkyl Benzene Sulphonate

**$C_{14.8}$ HAPS is Alkyl (average 14.8) Dimethyl ammonio 2-hydroxy propane sulphonate

SUDSING PERFORMANCE OF DOBANOL 45-7 ACETATE COMPOSITIONS

| | | EXAMPLES | | | | | | STANDARDS | | | |
|---|---|---|---|---|---|---|---|---|---|---|---|
| | | I | II | III | IV | V | VI | I | II | III | IV |
| Minidrum 2° H | Max. Suds Height (in.) | 5.6 | 5.0 | 4.0 | | 7.6 | 7.5 | 11.8 | 13 | >14 | 4.4 |
| | Max. Suds Temp. (° C) | 43 | 42 | 35 | | 41 | 57 | | ≧72 | | 35 |
| | Suds Collapse Temp. (° C) | 54 | 52 | 56 | | 81 | 77 | | | | 48 |
| Minidrum 18° H | Max. Suds Height (in.) | | 3.7 | 3.9 | | | 7.7 | | | >14 | |
| | Max. Suds Temp. (° C) | | 32 | 29 | | | 55 | | | | |
| | Suds Collapse Temp. (° C) | | 60 | 50 | | | 74 | | | | |
| U.K. Laundry | Max. Suds Height - 2° H | | | | 4.6 | 3.9 | | | | | |
| | Max. Suds Heights - 18° H | | | | 5.75 | 1.6 | | 9 | | | |
| | Wash | | 3.0 | | | | 4.0 | 3.6 | | | |
| Rinsing | Rinse 1 | | 2.7 | | | | 1.8 | 3.0 | | | |
| | Rinse 2 | | 1.0 | | | | 1.5 | 1.3 | | | |
| | Rinse 3 | | 0.3 | | | | 1.2 | 0.4 | | | |
| | Rinse 4 | | 0.0 | | | | 0.7 | 0.0 | | | |

CLEANING PERFORMANCE OF DOBANOL 45-7 ACETATE COMPOSITIONS

| | | | EXAMPLES | | | | | | STANDARDS | | | |
|---|---|---|---|---|---|---|---|---|---|---|---|---|
| | | | I | II | III | IV | V | VI | I | II | III | IV |
| DMO Stain Removal | Cotton | 50° | 60 | 59 | 59 | | | 48 | 60 | | | |
| | | 60° | 65 | 64 | 64 | | | 61 | 65 | | | |
| | | 85° | 74 | 77 | 73 | | | 72 | 74 | | | |
| | Polyester Cotton | 50° | 45 | 39 | 43 | | | 29 | 45 | | | |
| | | 70° | 55 | 53 | 52 | | | 41 | 53 | | | |
| DOO Stain Removal | Cotton | 50° | | 53 | | | | 52 | 49 | | | |
| | | 60° | | 52 | | | | 62 | 50 | | | |
| | | 85° | | 62 | 66 | | | 81 | 62 | | | |
| | Polyester Cotton | 50° | | 42 | | | | 57 | 47 | | | |
| | | 70° | | 49 | 55 | | | 63 | 48 | | | |
| Krefeld Stain Removal | Cotton | 50° | 53 | 51 | 53 | | | 63 | 54 | | | |
| | | 60° | 64 | 60 | 62 | | | 78 | 63 | | | |
| | | 85° | 74 | 76 | 73 | | | 84 | 68 | | | |
| | Polyester Cotton | 50° | | 60 | | | | 83 | 63 | | | |
| | | 70° | 66 | 65 | 65 | | | 83 | 66 | | | |

EXAMPLES VII TO IX

In Examples VII to IX, the suds depressant is Dobanol 45-7 propionate. The compositions and performance of these Examples are shown in Table V when it is again apparent that the propionates are effective suds depressants for nonionic surfactants and may be incorporated in detergent compositions with little or no loss in cleaning performance.

TABLE V

SUDSING AND CLEANING PERFORMANCE OF DOBANOL 45-7 PROPIONATE COMPOSITIONS

| | | | EXAMPLES | | |
|---|---|---|---|---|---|
| | | | VII | VIII | IX |
| Composition | | | | | |
| Dobanol 45-7 Propionate | | | 3 | 4 | 6 |
| Dobanol 45-7 | | | 9 | 8 | 6 |
| Sodium Sulphate | | | 12 | 12 | 12 |
| Sodium Silicate | | | 6 | 6 | 6 |
| Sodium Tripolyphosphate | | | 33 | 33 | 33 |
| Sodium Perborate | | | 25 | 25 | 25 |
| Sudsing Performance | | | | | |
| Minidrum 2° H | Max. Suds Height (in.) | | 8.2 | 5.6 | 5.3 |
| | Max. Suds Temp. (° C) | | | 38 | |
| | Suds Collapse Temp. (° C) | | | 53 | |
| Cleaning Performance | | | | | |
| DMO Stain Removal | Cotton | 50° | 56 | 57 | |
| | | 60° | 60 | 60 | |
| | | 85° | 72 | 72 | |
| | Polyester Cotton | 50° | | | |
| | | 70° | 51 | 52 | |
| DOO Stain Removal | Cotton | 50° | 48 | 48 | |
| | | 60° | 49 | 47 | |
| | | 85° | | | |
| | Polyester Cotton | 50° | 42 | 42 | |
| | | 70° | 49 | 49 | |

TABLE V-continued

SUDSING AND CLEANING PERFORMANCE OF DOBANOL 45-7 PROPIONATE COMPOSITIONS

| | | | EXAMPLES | | |
|---|---|---|---|---|---|
| | | | VII | VIII | IX |
| Krefeld Stain Removal | Cotton | 50° | | | |
| | | 60° | 45 | 42 | |
| | | 85° | 67 | 76 | |
| | Polyester Cotton | 50° | 61 | 59 | |
| | | 70° | 65 | | |

EXAMPLES X TO XXI

These examples demonstrate the suds depressant performance of Dobanol 45-4 acetate in compositions containing various nonionic and ionic surfactants. Dobanol 45-4 acetate is a more effective suds depressant than the corresponding 45-7 acetate at it has a higher content of ethoxylated components having HLB values of less than 7.5. Thus, Dobanol 45-4 acetate is an extremely effective suds depressant even at 10 percent by weight based upon the weight of the main nonionic component. On increasing the level to 20 percent, the sudsing behavior of the nonionic is almost completely suppressed in the minidrum test. In the more realistic laundry sudsing test, however, a small level of suds and a dependance of the sudsing performance upon water hardness is found. Examples XVI to XVIII illustrate compositions made by spraying the nonionic component onto a carrier granule containing LAS granulating aid, as described in the copending British Patent Application 74/16164, while Examples XIX to XXI illustrate compositions in which the granulating aid is Methocell. As it may be seen from Table VI, Dobanol 45-4 acetate is an effective suds depressant in both instances.

TABLE VI

SUDSING PERFORMANCE OF DOBANOL 45-4 ACETATE COMPOSITIONS

| | | X | XI | XII | XIII | XIV | XV | XVI | XVII | XVIII | XIX | XX | XXI |
|---|---|---|---|---|---|---|---|---|---|---|---|---|---|
| Composition | | | | | | | | | | | | | |
| Dobanol 45-4 Acetate | | 1.2 | 2.4 | 4 | 6 | 2 | 3 | 2 | 2 | 3 | 3 | 1 | 6 |
| Dobanol 45-7 | | 10.8 | 9.6 | 8 | 6 | 10 | 9 | 10 | | 9 | | 11 | 6 |
| Dobanol 45-4 | | | | | | | | | 10 | | | | |
| LAS | | | | | | | | 1 | 1 | 1 | | | |
| Synperonic 7 | | | | | | | | | | | 9 | | |
| Methocell | | | | | | | | | | | 1 | 1 | 1 |
| Sodium Sulphate | | 12 | 12 | 12 | 12 | 12 | 12 | 11 | 11 | 11 | 11 | 11 | 11 |
| Sodium Silicate | | 6 | 6 | 6 | 6 | 6 | 6 | 6 | 6 | 6 | 6 | 6 | 6 |
| Sodium Tripolyphosphate | | 33 | 33 | 33 | 33 | 33 | 33 | 33 | 33 | 33 | 33 | 33 | 33 |
| Sodium Perborate | | 25 | 25 | 25 | 25 | 25 | 25 | 25 | 25 | 25 | 25 | 25 | 25 |
| Sudsing Performance | | | | | | | | | | | | | |
| Minidrum | Max. Suds Height (in.) | 3 | 0.75 | 0.3 | 0.2 | | | | | | | | |
| 2° H | Max. Suds Temp. (° C) | 45 | 45 | 45 | 45 | | | | | | | | |
| | Suds Collapse Temp (° C) | 60 | | | | | | | | | | | |
| U.K. Laundry | 2° H | | | | | | | | | | 6.2 | 5.0 | 2.6 |
| Max. Suds | 12° H | | | | | 2.7 | 2.7 | | | | | | |
| Height (in.) | 18° H | | | | | 4.4 | | 4.2 | 2.5 | 3.5 | 3.3 | 2.6 | 3.5 |

EXAMPLES XXII TO XXVIII

Table VII illustrates the performance of Dobanol 45-4 acetate under typical European laundry conditions. The laundry sudsing test for French conditions differs from the test described earlier for U.K. conditions, in the following ways. The front loading automatic machine chosen was the Meile Automatic and the test was performed using a prewash followed by a boil-wash on the 95° cycle of the automatic in 18° H water (10:1 CaMg ratio). 70 grams of product was used in the prewash followed by 140 grams of product in the boil-wash. A 91 pound load of cotton sheets, pillowcases, towels and tea towels were washed in each instance.

Under German conditions, the nonionic product was used only in the prewash, and the 95° C mainwash was performed using a standard anionic detergent composition. 60 grams of product was used in both the prewash and the mainwash cycles, and the water hardness was set at 18° H with a 5.1 Ca/Mg ion ratio.

The sudsing results show that the Dobanol 45-4 acetate is an effective suds-depressant even under the extreme "boil-wash" conditions prevalent on the continent of Europe. It is also seen to have some value as a prewash product by virtue of a "carry-over" of suds-depressant into the main-wash cycles.

TABLE VII

SUDSING PERFORMANCE OF DOBANOL 45-4 ACETATE COMPOSITIONS UNDER EUROPEAN CONDITIONS

| | XXII | XXIII | XXIV | XXV | XXVI | XXVII | XXVIII |
|---|---|---|---|---|---|---|---|
| Compositions | | | | | | | |
| Dobanol 45-4 Acetate | 1 | 2 | 3 | 3 | 3 | 3 | 5 |
| Dobanol 45-7 | 11 | 10 | 9 | 10 | 12 | 12 | 5 |
| $C_{14,8}$ HAPS | | | | | | | 5 |
| Sodium Sulfate | 14 | 14 | 14 | 13 | 11 | 21 | 21 |
| Sodium Silicate | 6 | 6 | 6 | 6 | 6 | 5 | 5 |
| Sodium Tripolyphosphate | 32 | 32 | 32 | 32 | 32 | 45 | 45 |
| Sodium Perborate | 13 | 13 | 13 | 13 | 13 | | |
| Sudsing Performance | | | | | | | |
| French Laundry - Max. Suds Height (In.) | 6.2 | 5.6 | 2.8 | 5.7 | 7.0 | | |
| German Laundry - Max. Suds Height (In.) | | | | | | 12.0 | 5.7 |

EXAMPLES XXIX AND XXX

Table VIII exemplifies the sudsing characteristics of two Dobanol 45-4 acetate compositions under hand sudsing conditions.

Hand Sudsing Test

A perspex bowl was filled with one gallon of water at 18° Hardness and 115° F, and 22.5 g of the test composition was added to make a 0.5% concentration solution. The water was agitated by hand for 30 seconds, and the initial suds height was recorded. The suds were allowed to settle without agitation for a period of 2 minutes and the suds height was recorded again. The clean towels were then placed in the bowl and these were immersed, lifted and squeezed 16 times each over a period of one minute. They were then removed and squeezed along their length, and the so-called towel suds height was recorded. The towels were then placed in a fresh gallon of cold, 18° Hardness water, each were lifted and squeezed four times each over a period of 30 seconds, and they were finally removed and squeezed along their length. The first rinse suds height was then recorded. The rinsing operation was repeated in fresh rinsing water until no more suds were observable.

Comparing the hand sudsing results of Example XXIX and Standard V, it may be seen that Dobanol 45-4 acetate depresses the hand suds height to a certain degree but that the suds are quite stable at the lower level. The one composition is thus highly suitable for use both in a front-loading automatic washing machine situation, where a low level of suds is essential, and in the hand-washing situation, where a stable, moderately high level of suds is desirable. Once again, the excellent hand washing characteristics are clearly evident by comparing Example XXX, a subsuppressed Dobanol 45-7 composition, with Standard VI, a Dobanol 45-4 composition which has similar sudsing characteristics in the automatic washing machine contest. The superior hand washing characteristics of the formulation comprising Dobanol 45-4 acetate is apparent.

TABLE VIII

| | | EXAMPLES | | STANDARD | |
|---|---|---|---|---|---|
| | | XXIX | XXX | V | VI |
| Composition | | | | | |
| Dobanol 45-4 Acetate | | 3 | 3 | | |
| Synperonic 6 | | 9 | — | 12 | |
| Dobanol 45-7 | | | 9 | | |
| Dobanol 45-4 | | | | | 12 |
| LAS | | | 1 | | 1 |
| Methocell | | 0.1 | — | 0.1 | |
| Sodium Sulfate | | 12 | 12 | 12 | 12 |
| Sodium Silicate | | 6 | 6 | 6 | 6 |
| Sodium Tripolyphosphate | | 33 | 33 | 33 | 33 |
| Sodium Perborate | | 25 | 25 | 25 | 25 |
| Handsudsing Performance in Inches | | | | | |
| 2° H | Initial Suds Height | 1.4 | | 1.5 | |
| | 2 Min. Suds Height | 0.9 | | 1.0 | |
| | Towel Suds Height | 0.6 | | 1.2 | |
| | 1st Rinse Suds Height | 0.3 | | 0.5 | |
| | 2nd Rinse Suds Height | 0.3 | | 0.4 | |
| 18° H | Initial Suds Height | 1.0 | 1.0 | 1.6 | 0.5 |
| | 2 Min. Suds Height | 0.6 | 0.7 | 1.0 | 0.3 |
| | Towel Suds Height | 0.6 | 0.4 | 0.6 | 0.1 |
| | 1st Rinse Suds Height | 0.3 | 0.3 | 0.4 | |
| | 2nd Rinse Suds Height | 0.2 | | 0.3 | |

EXAMPLES XXXI to XXXVIII

Tables IX and X demonstrate the sudsing performance of a variety of Dobanol 45 and 91 series ethoxylate acetates. The results show that the lower homologs in each series are all effective suds-depressants in a standard Dobanol 45-7 nonionic formulation.

TABLE IX

SUDSING PERFORMANCE OF VARIOUS DOBANOL 4 SERIES ACETATES

| | EXAMPLES | | | | |
|---|---|---|---|---|---|
| | XXXI | XXXII | XXXIII | XXXIV | XXXV |
| Composition | | | | | |
| Dobanol 45-1 Acetate | 3 | | | | |
| Dobanol 45-2 Acetate | | 3 | | | |
| Dobanol 45-3 Acetate | | | 3 | | |
| Dobanol 45-7 Acetate | | | | 3 | |
| Dobanol 45-11 Acetate | | | | | 3 |
| Dobanol 45-7 | 9 | 9 | 9 | 9 | 9 |
| Sodium Sulfate | 12 | 12 | 14 | 14 | 14 |
| Sodium Silicate | 6 | 6 | 6 | 6 | 6 |
| Sodium Tripolyphosphate | 33 | 33 | 32 | 32 | 32 |
| Sodium Perborate | 25 | 25 | 13 | 13 | 13 |
| Sudsing Performance | | | | | |
| U.K. Laundry, 2° H | 5.6 | 4.5 | | | |
| Max. Suds Height (In.) | | | | | |
| 18° H | 5.5 | 3.5 | | | |
| French Laundry | | | | | |
| Max. Suds Height (In.) | | | | | |
| 18° H | | | 1.4 | 4.7 | 4.8 |

TABLE X

SUDSING PERFORMANCE OF DOBANOL 91 SERIES ACETATES

| | EXAMPLES | | |
|---|---|---|---|
| | XXXVI | XXXVII | XXXVIII |
| Composition | | | |
| Dobanol 91-3 Acetate | 3 | — | — |
| Dobanol 91-4 Acetate | — | 3 | — |
| Dobanol 91-6 Acetate | — | — | 3 |
| Dobanol 45-7 | 9 | 9 | 9 |
| Sodium Sulfate | 12 | 12 | 12 |
| Sodium Silicate | 1 | 1 | 1 |
| Sodium Tripolyphosphate | 33 | 33 | 33 |
| Sodium Perborate | 25 | 25 | 25 |
| Sudsing Performance | | | |
| U.K. Laundry 2° H | 5.1 | 5.2 | 6.2 |
| Max. Suds Height (In.) | | | |
| 18° H | 3.8 | 6.2 | 6.1 |

EXAMPLES XXXIX to XLVI

In Tables XI and XII are given compositions and sudsing data for a number of formulations based on stripped capped nonionics which are obtained from Dobanol 45-4 acetate and Dobanol 91-3 acetate respectively. The "stripped" capped nonionics are fractions obtained by vacuum distillation, so that Examples XXXIX to XLII comprise fractions of increasing molecular weight and average ethoxylate content in the Dobanol 45 series, while Examples XLIII to XLVI comprise corresponding fractions in the Dobanol 91 series. In addition, composition and sudsing data is gathered for a number of examples quoted in earlier Tables, and the combined data has been used to correlate suds-depressant activity with ethoxylate chain length for a given alcohol precursor. The compositions of the various ethoxylates have been obtained by application of gas-liquid chromatography making no allowance for variation in the response factor of the instrument to different ethoxylate chain lengths. While the absolute values of the figures quoted in the Tables should be viewed with caution, it is believed that the general conclusions resulting from their use are broadly correct.

It may be seen that, in both the Dobanol 45 and 91 cases, the 0–10% distillate fractions contain a large proportion of nonethoxylated material and a relatively low proportion of $E_1$ and $E_2$ components. The 20 to 30% fractions, on the other hand, have a much higher $E_1$ and $E_2$ content, and these fractions evidently coincide with optimum suds-depressant performance. The importance of the low ethoxylate components is further underlined by the correlation data given in Table XIII.

TABLE XI

| SUDSING PERFORMANCE OF CAPPED DOBANOL 45 SERIES ETHOXYLATES AND DISTILLATES THEREOF | | | | | | | | |
|---|---|---|---|---|---|---|---|---|
| | EXAMPLES | | | | | | | |
| Composition | XXXII 45.3 Ac. | XXIV 45.4 Ac. | XXXIV 45.7 Ac. | XXXIII 45.11 Ac. | XXXIX 45.4 Ac. | XL 45.4 Ac. | XLI 45.4 Ac. | XLII 45.4 Ac. |
| Ethoxylate Components | | | | | | | | |
| $E_0$ | 27.7 | 23.8 | 9.7 | 4.7 | 84.7 | 60.9 | 5.6 | — |
| $E_1$ | 13.0 | 7.6 | 3.5 | 1.8 | 8.3 | 21.3 | 46.3 | 0.4 |
| $E_2$ | 12.3 | 9.0 | 4.7 | 2.4 | 1.3 | 5.9 | 26.1 | 10.6 |
| $E_3$ | 11.1 | 9.9 | 6.3 | 2.9 | | 1.2 | 8.1 | 17.2 |
| $E_4$ | 8.7 | 8.7 | 6.9 | 4.4 | | | 1.7 | 17.6 |
| $E_5$ | 6.3 | 6.8 | 7.3 | 5.5 | | | 0.1 | 14.8 |
| $E_6$ | 4.7 | 5.7 | 7.9 | 6.6 | | | | 12.5 |
| $E_7$ | 3.3 | 5.0 | 8.1 | 8.1 | | | | 9.9 |
| $E_8$ | 2.4 | 3.7 | 8.0 | 8.7 | | | | 7.1 |
| $E_9$ | 1.7 | 3.5 | 7.9 | 11.5 | | | | 4.6 |
| $E_{10}$ | 1.1 | 2.1 | 7.8 | 13.7 | | | | 2.0 |
| Dobanol 45-7 | 300 | 300 | 300 300 | 300 | 300 | 300 | 300 | |
| Sodium Sulfate | 467 | 467 | 467 | 467 | 467 | 467 | 467 | 467 |
| Sodium Silicate | 200 | 200 | 200 | 200 | 200 | 200 | 200 | 200 |
| Sodium Tripolyphosphate | 1067 | 1067 | 1067 | 1067 | 1067 | 1067 | 1067 | 1067 |
| Sodium Perborate | 433 | 433 | 433 | 433 | 433 | 433 433 | 433 | |
| French Laundry 18° H Max. Suds Height (1M) | 1.4 | 2.8 | 4.7 | 4.8 | 5.5 | 2.2 | 1.5 | 2.8 |

TABLE XII

| SUDSING PERFORMANCE OF CAPPED DOBANOL 91 SERIES ETHOXYLATES AND DISTILLATED THEREOF | | | | | | | |
|---|---|---|---|---|---|---|---|
| | EXAMPLES | | | | | | |
| Composition | XXXIV 91-3 Ac. | XXV 91-4 Ac. | XXVI 91-5 Ac. | XLIII 91-3 Ac. | XLIV 91-3 Ac. | XLV 91-3 Ac. | XLVI 91-3 Ac. |
| | | | | 0-10% | 10-25% | 20-30% | 30-100% |
| Ethoxylate Components | | | | | | | |
| $E_0$ | 18.3 | 13.6 | 5.8 | 70.4 | 51.9 | 12.4 | — |
| $E_1$ | 12.4 | 9.6 | 4.2 | 9.6 | 27.6 | 47.7 | 2.8 |
| $E_2$ | 12.3 | 11.7 | 5.7 | 1.2 | 5.9 | 25.4 | 15.2 |
| $E_3$ | 11.8 | 12.9 | 7.8 | 0.2 | 0.8 | 5.3 | 21.4 |
| $E_4$ | 10.7 | 12.7 | 9.6 | — | — | 0.6 | 19.3 |
| $E_5$ | 8.2 | 10.5 | 10.1 | — | — | — | 14.7 |
| $E_6$ | 6.6 | 8.8 | 10.4 | — | — | — | 10.7 |
| $E_7$ | 5.0 | 6.9 | 9.9 | — | — | — | 5.4 |
| E;hd 8 | 3.9 | 5.4 | 7.7 | — | — | — | 5.1 |
| $E_9$ | 3.0 | 3.9 | 7.7 | — | — | — | 2.0 |
| $E_{10}$ | 2.4 | 2.3 | 6.3 | — | — | — | 0.6 |
| Dobanol 45-7 | 300 | 300 | 300 | 300 | 300 | 300 | 300 |
| Sodium Sulfate | 400 | 400 | 400 | 400 | 400 | 400 | 400 |
| Sodium Silicate | 200 | 200 | 200 | 200 | 200 | 200 | 200 |
| Sodium Tripolyphosphate | 1100 | 1100 | 1100 | 1100 | 1100 | 1100 | 1100 |
| Sodium Perborate | 833 | 833 | 833 | 833 | 833 | 833 | 833 |
| U.K. Laundry, 2° H | 5.1 | 5.2 | 6.2 | 3.3 | 4.6 | 3.3 | 5.5 |
| Max. Suds Height (In.) 18° H | 3.8 | 6.2 | 6.1 | 4.4 | 4.1 | 3.7 | 4.4 |

EXAMPLES XLVII and XLVIII

Two front loading automatic washing machine compositions were prepared having the formulations shown below and their suds-depressant performance was evaluated in comparison with Standards VII and VIII in a minidrum sudsing test.

TABLE XIII

| CORRELATON COEFFICIENTS BETWEEN ETHOXY CHAINLENGTH AND SUDS DEPRESSANT ACITVITY FOR DOBANOL 91 AND 45 ACETATES | | | | | |
|---|---|---|---|---|---|
| | DOBANOL 91 SERIES ACETATES | | | DOBANOL 45 SERIES ACETATES | |
| CHAIN-LENGTH | HLB | CORRELATION COEFFICIENT 18° H | CORRELATION COEFFICIENT 2° H | HLB | CORRELATION COEFFICIENT 18° H |
| $E_0$ | — | 0.04 | 0.11 | — | −0.02 |
| $E_1$ | 3.85 | 0.36 | 0.32 | 2.75 | 0.58 |
| $E_2$ | 6.65 | 0.15 | 0.19 | 5.15 | 0.69 |
| $E_3$ | 8.55 | −0.19 | −0.11 | 6.95 | 0.47 |
| $E_4$ | 9.95 | −0.27 | −0.22 | 8.35 | 0.18 |
| $E_5$ | 11.05 | −0.30 | −0.29 | 9.45 | −0.04 |
| $E_6$ | 11.95 | −0.33 | −0.35 | 10.35 | −0.23 |
| $E_7$ | — | −0.34 | −0.44 | — | −0.43 |
| $E_8$ | — | −0.34 | −0.43 | — | −0.57 |
| $E_9$ | — | −0.32 | −0.46 | — | −0.62 |

| Composition | EXAMPLES XLVII | EXAMPLES XLVIII | STANDARDS VII | STANDARDS VIII |
|---|---|---|---|---|
| Pluorinic L31 | | | 3 | |
| Pluorinic L31, Acetate | 3 | | | |
| Ethomeen 18/15 | | | | 3 |
| Ethomeen 18/15, Acetate | | 3 | | |
| Dobanol 45-7 | 9 | 9 | 9 | 9 |
| Sodium Sulfate | 12 | 12 | 12 | 12 |
| Sodium Silicate | 6 | 6 | 6 | 6 |
| Sodium Tripolyphosphate | 33 | 33 | 33 | 33 |
| Sodium Perborate | 25 | 25 | 25 | 25 |
| Sudsing Performance | | | | |
| Mini- Max. Suds Ht. (In.) | 0.6 | 0.55 | 3.5 | 3.3 |
| drum Max. Suds Temp. (° C) | 64 | 74 | 79 | 85 |
| 2° H Suds Collapse Temp (° C) | | | 83 | None |

Pluronic L31 (Pluronic being a Tradename of Wyandotte Chemical Corporation) is a condensate of ethylene oxide with a hydrophobic base formed by condensing propylene oxide with propylene glycol. If has a molecular weight of about 1100 and a means HLB of about 4.5. Ethomeen 18/15 (Ethomeen being a Tradename of Armour-Hess Chemicals Limited) has the general formula

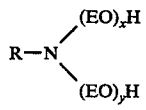

in which R is a $C_{18}$ stearyl group and the sum of $x$ and $y$ averages about 5.

It may be seen that the capped surfactants are extremely effective suds-depressants in nonionic detergent formulations, and indeed such formulations may be rendered substantially non-sudsing by including as little as 3% of either of the capped surfactants.

EXAMPLES XLIX and L

Two heavy-duty liquid detergent compositions have the following formulation

| Composition | EXAMPLES XLIX | EXAMPLES L |
|---|---|---|
| Dobanol 45-7 | 27 | 27 |
| Dobanol 45-4 Acetate | 3 | 3 |
| Oleic Acid | 10 | 3.5 |
| Monoethanolamine | 10 | 10 |
| Linear $C_{11-13}$ Alkylbenzene Sulfonic Acid | | 6.5 |
| Water | 50 | 50 |

EXAMPLES LI and LII

Two automatic dishwasher detergent compositions falling within the scope of the invention have the following formulation

| Composition | EXAMPLES LI | EXAMPLES LII |
|---|---|---|
| Sodium Tripolyphosphate | 6.6 | |
| Sodium Silicate | 16.5 | 28.4 |
| Sodium Acetate | | 48.3 |

-continued

| Composition | EXAMPLES LI | EXAMPLES LII |
|---|---|---|
| Potassium Dichlorocyanurate | 3.5 | 3.5 |
| Sodium Sulfate | 5.3 | 5.3 |
| Dobanol 23-6.5 | 3.0 | 8.0 |
| Dobanol 45-4 Acetate | 2.0 | 3.0 |
| Water | 3.7 | 3.5 |

What is claimed is:

1. A detergent composition consisting essentially of
(a) from 0.5% to 95% by weight of a nonionic detergent and
(b) suds-depressing surface-active agent having the general formula $RO(C_nH_{2n}O)_x—COR^3$, in which R is an alkyl group comprising 8 to 20 carbon atoms, $n$ is 2, 3 or 4, $x$ represents the average degree of alkoxylation and is from 0.5 to 7 and $R^3$ represents an alkyl or alkenyl group having one to nine carbon atoms, the weight ratio of (b) to (a) being at least 1 to 12.

2. A detergent composition according to claim 1 and additionally comprising from about 5% to about 90% by weight of a detergency builder salt selected from the group consisting of alkali metal salts of polyphosphate, carbonate, silicate, citrate, oxydisuccinate, carboxymethyloxysuccinate, benzene tetra, penta or hexacarboxylate, benzene 1,3,5-tricarboxylate, 1,3,5-hydroxybenzene-2,4,6-trisulfonate, nitrilotriacetate, an alumino silicate of formula $Na_{12}(AlO_2.SiO_2).27H_2O$, and mixtures thereof.

3. A detergent composition according to claim 1 wherein the suds-depressing surface active agent comprises at least 2% by weight thereof alkoxylated components having HLB values of less than 7.5.

4. A detergent composition according to claim 3 in which at least 4.5% of the suds-depressing agent is alkoxylated with an HLB of less than 7.5.

5. A detergent composition according to claim 4 in which at least 15% of the suds-depressing agent is alkoxylated with an HLB of less than 7.5.

6. A detergent composition according to claim 5 in which $\bar{x}$ is from 1 to 5.

7. A detergent composition according to claim 6 in which the polyalkylene oxide moiety is a polyethylene oxide chain.

8. A detergent composition according to claim 7 in which the weight ratio of suds-depressing surface active agent (b) to detergent (a) is at least 1 to 6.

* * * * *